United States Patent [19]

Hethcoat

[11] Patent Number: 4,858,061

[45] Date of Patent: Aug. 15, 1989

[54] ELECTROSTATIC DISCHARGE CONTROL DEVICE

[75] Inventor: Gary L. Hethcoat, Ontario, Calif.

[73] Assignee: General Dynamics Corp., Pomona, Calif.

[21] Appl. No.: 164,169

[22] Filed: Mar. 2, 1988

[51] Int. Cl.[4] ..... H05F 3/02

[52] U.S. Cl. ..... 361/215

[58] Field of Search ..... 361/212, 215, 219, 220, 361/222, 225, 227, 228; 174/6, 51; 200/51.09

[56] References Cited

U.S. PATENT DOCUMENTS

| | | | |
|---|---|---|---|
| 2,753,491 | 7/1956 | Legge | 361/219 |
| 3,099,774 | 7/1963 | Crane | 361/220 |
| 3,462,183 | 8/1969 | Dudley et al. | 361/220 X |
| 3,577,208 | 5/1971 | Petrick | 361/222 |
| 3,621,164 | 11/1971 | Backer | 361/220 X |
| 3,935,508 | 1/1976 | Moister, Jr. | 361/222 |

*Primary Examiner*—L. T. Hix
*Assistant Examiner*—Brian W. Brown
*Attorney, Agent, or Firm*—Neil Martin; Leo R. Carroll

[57] ABSTRACT

A discharge control device for transferring accumulated electrostatic charge from containers used in spray painting, to a charge sink, comprising a housing having a hermetically sealed discharge chamber mounted inside. A first electrical contact for receiving an accumulated electrostatic charge is mounted in the discharge chamber in opposition to a reciprocating electrical contact for receiving and dissipating the accumulated charge from the first contact. The reciprocating contact is slidably mounted on the discharge chamber so that it moves between one position adjacent to or touching the first contact means and a second position spaced apart from the first contact. A first electrical conductor is connected between the first contact and the container, and a second conduction means is connected between the reciprocating contact means and the charge sink.

16 Claims, 1 Drawing Sheet

ELECTROSTATIC DISCHARGE CONTROL DEVICE

This invention was made with Government support under Contract No. N00024-86-C5412 awarded by the U.S. Navy. The Government has certain rights in this invention.

BACKGROUND OF THE INVENTION

1. Field of the Invention

The present invention relates to a method and apparatus for discharging high voltage and more particularly to an apparatus for discharging residual high voltage present on pressurized liquid containers utilized in elecrostatic spray painting equipment which applies water reducible coatings. The invention further relates to a method and apparatus for isolating high voltage electrostatic 2. Background of the Art.

Many commercial applications call for the application of smooth thin coats of water reducible paint to very large surfaces. Spray painting is the technique most often used to accomplish this in time and cost effective manner with a minimum of material. However, high pressure paint sprays or atomized paint streams may fail to deposit a large percentage of the paint on the surface being painted. Air turbulence, ventilation currents, and surface recoil interactions often disburse a fair amount of the pain into the air where it is distributed onto other surfaces or remains suspended for an extended period. This results in a decreased transfer efficiency for the paint material and also presents safety problems.

Many primers, thinners, and paint materials create biological health hazards when distributed in significant quantities in the air. Water soluble primers and the like can be readily absorbed by human physiological systems and cause a variety of health risks. Various Federal and State safety regulations often require that a minimal amount of sprayed paint or particulate matter adhere to the surfaces. being painted to prevent exposure to air borne substances. Therefore, to improve the cost effectiveness and health risks, electrostatic painting processes are typically used to assure that a minimum percentage of the pain particles, on the order of 61% or more, reach and adhere to the surface being painted.

In an electrostatic painting process, the paint is typically forced through a charged grid as part of the pressurized spraying process. The grid is typically charged to a voltage in excess of 75–100,000 volts at a negative or positive polarity and the working piece being painted is fixed at a ground potential at the opposite polarity. This means that the paint particles are either negatively or positively charged and are strongly attracted to the opposing charge of the painted surface which causes the particles to adhere strongly and rapidly to that surface. This technique reduces the loss of paint into the air to acceptable minimums.

Unfortunately, electrostatic painting also has associated safety hazards in the areas of electrical shock and explosion. The pressurized containers or pots holding the paint develops an accrued electrostatic, surface, charge on the order of 75–100,000 volts and is capable of delivering a considerably high current discharge to anyone coming in contact with the container. These containers have to be placed on electrically insulated stands for operation and are often surrounded by safety barriers to prevent contact by painting personnel. In addition, a grounding strap, probe, or similar discharge element is provided to discharge any residual electrostatic charge remaining on the container at the end of its use.

Generally a control unit associated with the electrostatic charging assembly is designed to drain off residual charge once the unit is no longer functioning. However, it is quite common that existing control units are not capable of handling all of the charge present on the pressurized container and the use of a safety grounding probe does in fact discharge a substantial amount of voltage. When any discharge occurs to through a grounding probe, it creates a discharge arc through the air surrounding the portion of the probe closest to the pressurized container. This gives rise to the potential for initiating an explosion.

Although an electrostatic process is more efficient at transferring material to a painted surface, there is still a significant percentage of material present in the air adjacent to the pressurized container. In addition, painting is often carried on in a paint shop or work area where other solvents and materials are being deposited into the air. Since many paints, primers, and solvents being sprayed are potentially very volatile and explosive, an electrical discharge could prove disastrous.

Current safety discharge mechanisms and discharge control systems do not guarantee a full and complete discharge of residual charge from paint containers nor do they prevent the presence of discharge arcs in the air surrounding pressurized containers. What is needed, then, is a method or apparatus which safely guarantees the discharge of any residual electrostatic charge on such pressurized containers. It is also desirable that any such apparatus comprise a mechanically simple and cost efficient device which can be readily adapted for use on a variety of electrostatic painting equipment.

SUMMARY OF THE INVENTION

In view of the above shortcomings of the art, it is an object of the present invention to provide an electrostatic discharge control device for use with electrostatic painting equipment which prevents discharge of electrical surface charges in an open environment.

It is an advantage of the present invention that it provides an electrostatic discharge switch which is very cost efficient to construct and easily incorporated in existing electrostatic paint equipment.

These and other purposes, advantages, and objects of the present invention are realized in an electrostatic discharge control device for transferring accumulated electrostatic charge from containers used in spray painting, to a charge sink, comprising a housing having a hermetically sealed discharge chamber mounted inside, typically by a tubing clamp secured to a sidewall of the housing. A first electrical contact for receiving an accumulated electrostatic charge is mounted in the discharge chamber along with an opposing reciprocating electrical contact for receiving and dissipating the accumulated charge from the first contact. The reciprocating contact is slidably mounted on a surface of the discharge chamber so that it moves between one position adjacent to or touching the first contact means and a second position spaced apart from the first contact. A first electrical conductor is connected between said first contact and the container for and a second conduction means is connected between the reciprocating contact means and the charge sink.

In further aspects of the invention, the chamber comprises a support tube, preferably of cylindrical glass, having opposing ends with the first electrical contact mounted on one end and the reciprocating contact mounted on a second end. The reciprocating contact comprises a nonconductive rod positioned to extend into the tube with a handle on the opposite end extending through a sidewall of said housing. A retainer ring is positioned along the rod with a spring disposed between the tube and the retainer ring and resting on a plate disposed across the end of the tube with a hole for passage of the rod. A conductive contact point extends from the rod inside the tube and is connected to the second electrical conduction means. To provide a hermetic seal during motion of the rod within the tube, an annular sealing member is disposed about the periphery of the rod and has external dimensions and shapes to coincide with the internal dimensions of the tube. In addition an annular guide ring may be employed adjacent to the contact end of the rod.

The housing further comprises a viewing port disposed in a front wall to allow viewing of the electrical discharge contacts during operation. A rubber cover boot may be disposed about the housing with mounting lugs for securing the housing to a surface.

The first electrical contact means comprises a removable cylindrical body member having a planar top and a threaded projection extending from the bottom secured to an electrical conductor having a central conductive core with a small passage for accepting a threaded body member. The contact means can be removed for servicing or replacement. The second electrical conduction means comprises a first electrical conductor of predetermined size connected to an electrical feedthrough disposed on a sidewall of the housing with a second electrical conductor of predetermined size connected between the feedthrough and the charge sink.

BRIEF DESCRIPTION OF THE DRAWINGS

The novel features of the present invention may be better understood from the accompanying description when taken in conjunction with the accompanying drawings in which like characters refer to like parts and in which.

DETAILED DESCRIPTION OF A PREFERRED EMBODIMENT

The present invention provides a discharge control device for use on electrostatic painting systems or similar apparatus for safely discharging residual electrostatic charge present in the painting system. The control device isolates any electrical arc created during discharge of a painting system from communicating with the surrounding atmosphere. The discharge control device comprises a housing which supports a reciprocating rod type discharge switch with an actuation handle extending through one wall of the housing. The discharge switch is hermetically sealed to prevent access of local atmosphere to interior discharge surfaces and thereby prevent interaction with any arc created as the switch is operated.

Figure 1:
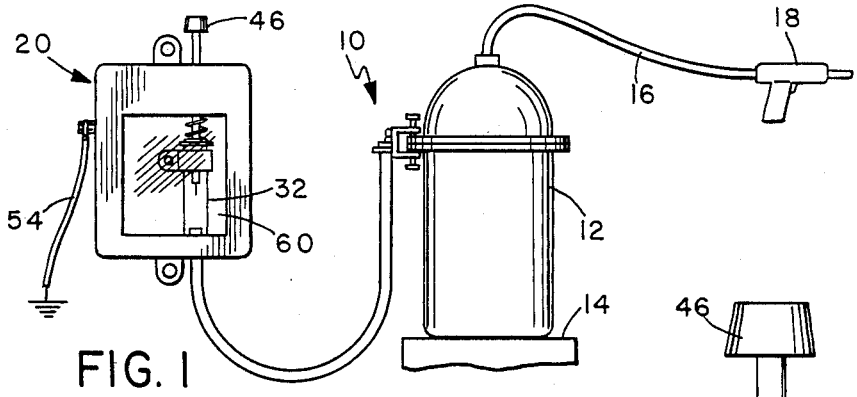
FIG. 1 illustrates a typical electrostatic painting system incorporating a discharge control device constructed according to the principles of the present invention.

A typical electrostatic painting apparatus is illustrated in FIG. 1 utilizing the safety discharge device of the present invention. In FIG. 1, an electrostatic painting apparatus 10 comprises a pressure container or pot 12 which is positioned on top of an electrical isolation stand 14. The pressure pot 12 is connected through a hose 16 to a spray nozzle 18 from which the paint will be disbursed and applied to a surface being painted (not shown). An electrostatic charging source (not shown) provides a high voltage charge on the order of 60–100,000 volts DC to the pressure pot 12 through a high voltage cable. Such voltage sources and associated electrical connections are well known in the electrostatic painting art and not illustrated in detail here.

During operation of the electrostatic painting apparatus 10, high voltage electricity is supplied to the pressure pot 12. An electrostatic charge is typically transferred to a series of grills, wires, or grids inside the pressure pot, and adjacent to the output connection or port for the hose 18, which charges the paint being released as previously discussed. When a painting job is completed or the pot 12 needs refilling with material, the charging power source is turned off and the voltage allowed to discharge.

In the typical electrostatic painting device, a controller connected to the pressure pot automatically discharges the pot surfaces to a ground connection when the pressure equipment is turned off. This discharge can be activated by the on/off switch for the paint equipment, or a pressure sensitive switch detecting the loss of the pumping pressure for the paint. As previously discussed, prior art controls often allowed some residual charge to remain on the exterior of the pressure pot 12 thus requiring the use of a grounding loop, strap, or probe 26 to assure complete dissipation of this charge. In addition, the discharge controller generally utilizes some type of open contact relay or switch structure which allows access to any generated discharge arc by the surrounding atmosphere. In any case, an explosion hazard is created due to the presence of an open air arc and a distribution of fine particulate matter in the local atmosphere.

To solve this problem and prevent explosions while providing maximum personnel safety and assurance, an electrostatic discharge control unit 20 is mounted on or adjacent to the pressure pot 12 and is electrically connected to the pressure pot 12 by a high voltage cable 22. The discharge control device 20, when constructed according to the principles of the present invention, discharges or removes excess electrostatic charge remaining on the pressure pot 12 without allowing the local atmosphere to interact with any electrical arc generated by this process.

Figure 2:
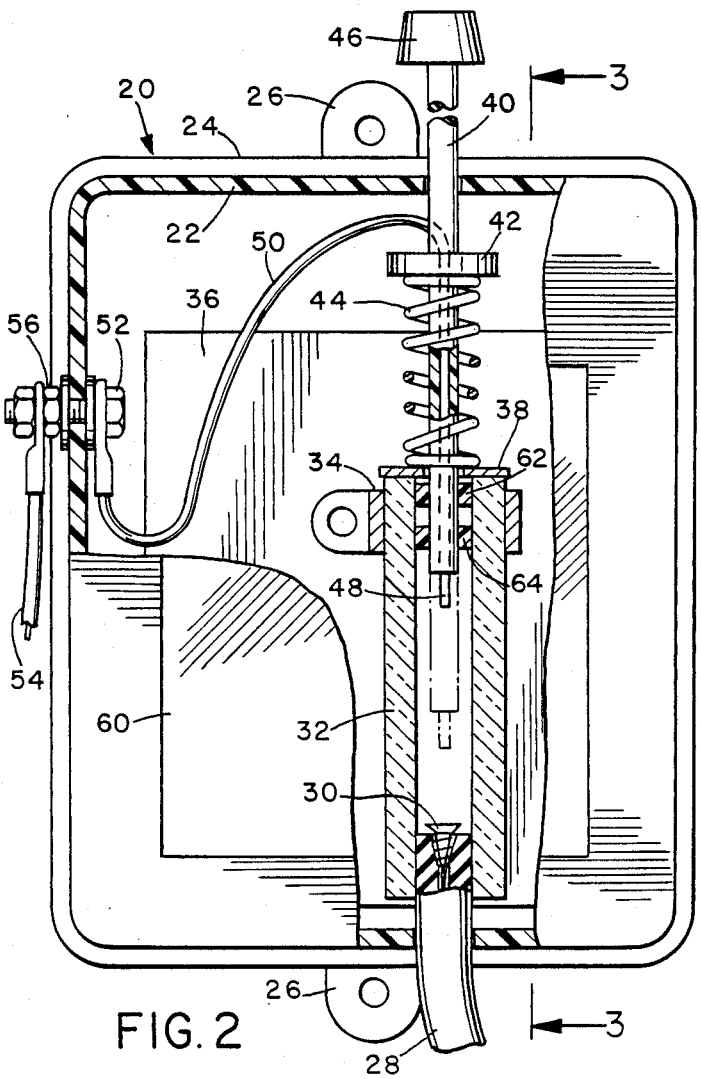
FIG. 2 illustrates an enlarged front elevation view of the discharge control device used in FIG. 1 with portions cut away.
Figure 3:
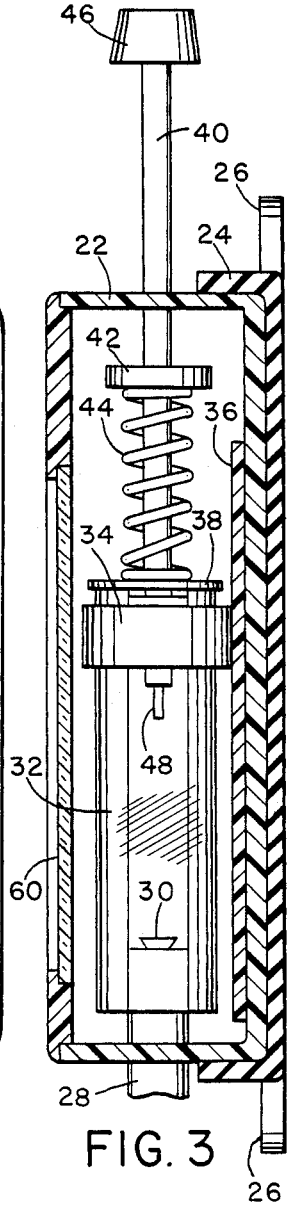
FIG. 3 illustrates a sectional view taken along line 3—3 of FIG. 2.

The electrostatic discharge control device 20 is illustrated in further detail in the front view of FIG. 2. In FIG. 2, the discharge control device 20 is partially cut-away to show an external housing 22 which completely surrounds and encloses electrical connections and discharge components utilized by the control device 20.

The housing 22 of the control device 20 typically comprises a nonmetallic external wall to minimize electrostatic charge build up and the chances of an alternate source of electrical contact or ground connection for a discharging current. Exemplary box materials are plastics such as, but not limited to, polyvinylchloride or other materials such as Bakelite or fiber reinforced resins, all of which are known to have insulating properties.

The housing 22 is mounted on a surface using one of several means which provide a good electrical stand off or insulation from surrounding surface charges. A preferred method of mounting the control device 20 is the use of a rubber boot mount structure 24 which encloses a substantial portion of the housing and provides one or more mounting lugs 26 for securing the control device in place using screws or bolts. The rubber boot 24 provides further insulation and general structural protection for the electrostatic control device 20. The exact percentage of housing 22 enclosed by the boot 24 varies according to specific mounting requirements and only needs to be enough to support the weight of the device 20 with a frictional fit.

A safety or discharge cable 28 is connected between the control device 20 and the pressurized paint container 12. This cable can be secured to the pressurized paint container using a conductive clamp, lug, or screw assembly which clamps against an exposed flange or other conductive projection on the container 12 and assures proper electrical contact with the conductive portion of the cable 28. The cable 28 comprises one of several high voltage conductors such as solid or multistrand insulated copper wires on the order or #10 or larger or 8 mm. or larger spark plug wire. The size of the conductor in the cable 28 is determined by the amount of voltage the container 12 can obtain and the maximum current that such a charge can deliver. Those skilled in the art will readily appreciate how these numbers allow design of a safe cable 28 which is generally designed with a large margin of protection.

The conductor 28 extends into the housing 22 and terminates in a substantially planer discharge surface or contact 30. It is found that the surface of the contact 30 ablates or corrodes over time due to the repetitive impact or shock from discharge arcs. Therefore, it is desirable to make th contact 30 interchangeable or replaceable to maintain efficient operation. This is accomplished by utilizing a conductive screw or screw like structure made of material such as brass or copper, having a substantially flat or smooth planar top surface. The threaded base of the contact 30 is inserted into a small bore in the end of the conductor 28. That is, a small bore or narrow depression is machined into a central portion of the conductive core of the cable 28 which allows insertion by threading, of the contact 30. This allows change out of the contact 30 surface whenever it becomes severely degraded or destroyed due to continual discharges.

The contact end of the conductor 28 extends into the base portion of a rod type switch mechanism which uses a guide or support tube 32 to support the contact 30 portion of the cable 28 in place. The inner diameter of the guide tube 32 can be made slightly smaller than the outside diameter of the cable 28 to secure the cable in place using friction or pressure. Alternatively, the cable 28 can be held in place using set screws, adhesives or potting compounds. It is important to achieve a seal between the support tube 32 and the cable 28 so that no air can traverse this end of the tube 32. The tube 32 can have several cross-sectional shapes but a circular cross section is preferred.

A grommet or a sealing compound, such as those known in the electronics arts, may be employed where the cable 28 engages the device housing 22 to prevent abrasion or damage to the cable insulation and seal the housing wall adjacent to the cable 28.

The generally cylindrical guide tube 32 comprises a non-conductive material such as glass which allows the discharge device 24 operator to view the electrode region during discharge. Glass is a preferred material because it is not easily damaged by electrical discharges as can happen to many plastics over an extended period of time.

The glass tube 32 is secured to one side of the housing 22 by a circular clamp 34. The clamp 34 is secured in place by a variety of means such as screws, bolts, or adhesives. Where desired a separate insulated support plate 36 which can be made of materials such as fiber reinforced glass, plastic or resin, is provided for mounting the clamp 34.

The top end of the tube 32 is closed by a cover washer or plate 38 having a central opening or aperture for passage of a non-conductive control or push rod 40. The control rod 40 is mounted to move up and down on the washer 38 so that a probe or discharge tip 48 is extended into the tube 32 to contact the electrical contact 30. An exemplary material for the control rod 40 is nylon although other materials may be employed. The control rod 40 is supported on top of the glass tube 32, washer 38 by a retainer 42 and spring 44. The annular retainer 42 is secured in a fixed vertical position along the length of the control rod 40 and sets a maximum extension of the control rod 40 into the tube 32. That is, as the control rod 40 extends into the tube 32, the retainer 42 approaches the washer 38 until the spring 44 is fully collapsed or the control rod 40 strikes the contact 30.

The upper end of the control rod 40 extends through a top wall of the housing 2 where it terminates in a handle 46 which serves as a means of activating an up and down motion of the control rod by a discharge device 20 operator.

A hollow passage is formed along a central axis of the control rod 40 and a discharge jumper or wire 50 is inserted down the center of control rod 40. The jumper 50 is positioned to have its conductive core extend a small amount beyond the end of the control rod 40 and form a contact tip 48. In the alternative, the end of the control rod 40 can be terminated by a conductive contact member similar to the contact 30 which is threaded into the rod 40 and removable for replacement or servicing of exposed surfaces. As the control rod 40 is moved up and down in the tube 32, the tip 48 will move adjacent to and away from the contact 30 allowing electrostatic charges to be transferred between these two surfaces.

The opposite end of the discharge jumper 50 is attached to a feedthrough conductor 52 positioned along one wall of the housing 22. The feedthrough assembly 52 typically comprises a conductive bolt extending through the sidewall of the housing 22 and secured in place by a series of nuts and washers. An external grounding cable 54 is mounted at one end on the external portion of the feedthrough 52 also using the nuts 56 and has its opposite end connected to a grounding surface or other charge sink (not shown) for absorbing the charges being dissipated by the control device 20.

It has been found beneficial to have operators observe the internal discharge components of the control device 20 during operation. First, there is a sense of security in observing the actual discharge taking place. Second, mechanical failures or changes in operating characteristics which indicate a need for service are easily observed. Therefore, the housing 22 is provided with a clear glass or plastic plate 60 on the front of the housing 22 so that a device operator can observe the discharge. This combined with a clear support tubing 32 provides adequate opportunity to monitor the function of the discharge device 20. In addition, this provides a chance to see if a charge was actually present on the container of interest which may be unknown.

As discussed above, it is desirable to prevent any local atmosphere, which may contain a variety of particulate matter or volatile substances, from interacting with any discharge arc or sparks produced in the control device 20. This is accomplished by assuring that the cable 28 is connected to the tube 32 in a manner that is air tight, sealing any gaps between the wire 50 conductor and the control rod 40, and by using a bushing 62 disposed about the control rod 40 inside of the tube 32.

The bushing 62 can slide with the rod 40 but is preferably fixed adjacent to the end of the tube 32. The bushing 62 is configured to have the same dimensions and contours as the interior of the tube 32 to provide an air tight seal between the outer diameter of the control rod 40 and the inside wall of the tube 32 so that no external atmosphere enters the discharge region during operation. In addition, to assure a proper seal and assist in the alignment of the control rod 40 during operation, a guide sleeve 64 is provided. Both the bushing 62 and the sleeve 64 are typically made of a tetra-flouro-hydrocarbon compound which provides a low friction sliding action for the control rod 40 while sealing any spaces or gaps.

Although the control device 20 has been described using a vertical arrangement for the tubing 32 and control rod 40, those skilled in the art will readily understand that the tubing and control rod can be mounted in other orientations and the handle can extend from the side or bottom of the control device 20.

The foregoing description of a preferred embodiment has been presented for purposes of illustration and description. It is not intended to be exhaustive nor to limit the invention to the precise form disclosed, and many modifications and variations are possible in light of the above teaching. The embodiment was chosen and described to best explain the principles of the invention and its practical application to thereby enable others skilled in the art to best utilize the invention in various embodiments and with various modifications as are suited to the particular use contemplated. It is intended that the scope of the invention be defined by the claims and their equivalents.

What I claim as my invention is:

1. A discharge control device for transferring accumulated electrostatic charge from containers or other apparatus used in spray painting, to a charge sink, comprising:

a housing;

a hermetically sealed discharge chamber disposed within said housing;

first electrical contact means for receiving an accumulated electrostatic charge mounted in said discharge chamber;

reciprocating electrical contact means for receiving and dissipating said accumulated electrostatic charge on said first contact slidably mounted on a surface of said discharge chamber and being movable between a first position in contact with said first electrical contact means and a second position spaced apart from said first electrical contact means; and first electrical conduction means connected at one end to said first contact means and having securing means at its opposite end for securing it to said container for conducting electrostatic charge between said container and said first contact means; and second electrical conduction means connected between said reciprocating contact means and said charge sink.

2. The device of claim 1 wherein said chamber comprises a support tube having opposing first and second ends with said first electrical contact means mounted on said first end and said reciprocating contact means mounted on said second end.

3. The control device of claim 2, wherein said support tube comprises a cylindrical glass tube.

4. The control device of claim 2 wherein said reciprocating contact means comprises:

a rod of non-conductive material, having a contact end positioned to extend into said tube from said second end and a handle end extending through a sidewall of said housing;

a retainer ring positioned along said rod;

a spring disposed between said tube end and said retainer ring;

a conductive contact point extending from said contact end of said rod connected to said second electrical conduction means; and an annular sealing member disposed about the periphery of said rod and having a perimeter configuration and dimensions substantially the same as said tube so as to slidably seal between said tube and said rod.

5. The device of claim 4 further comprising a plate disposed across said second end of the tube having a centrally located bore with said rod extending therethrough.

6. The device of claim 4 further comprising an annular guide means disposed about said rod adjacent said contact end configured to contact interior walls of said tube and maintain a central axis position for said control rod as it extends into said tube.

7. The control device of claim 2 further comprising a circular clamp disposed about said support tube and secured to a wall of said housing.

8. The device of claim 1 wherein said housing further comprises a viewing port disposed in a front wall thereof so as to allow viewing of said first and reciprocating contact means during operation.

9. The control device of claim 6 further comprising a rubber cover boot disposed about said housing having mounting lugs extending therefrom.

10. The device of claim 1 wherein said second electrical conduction mean comprises:

an electrical feedthrough disposed on a sidewall of said housing;

a first electrical conductor of predetermined size connected between said reciprocating electrical contact and said feedthrough; and a second electrical conductor of predetermined size connected between said feedthrough and said charge sink.

11. The device of claim 1 wherein said first electrical contact means is removably secured in said device for replacement after extended use.

12. The device of claim 1 wherein said first electrical contact means comprises:

a cylindrical body member having a top and a bottom with said top being planar and a threaded projection extending from the bottom; and an electrical conductor having a central conductive core surrounded by an insulating cover, said conductor terminating on one end in a small bore in said core for accepting said threaded body member.

13. The device of claim 12 wherein said electrical conductor terminates on a second end in a conductive clamp for securing to said container.

14. The device of claim 1 wherein said first and reciprocating electrical contact means are positioned sufficiently far apart in said second position to prevent discharge of electrostatic charges on said container through said reciprocating contact having less than a predetermined magnitude.

15. A discharge control device for transferring accumulated electrostatic charge from containers or other apparatus used in spray painting, to a charge sink, comprising;

a housing;

a hermetically sealed discharge chamber disposed within said housing;

first electrical contact means for receiving an accumulated electrostatic charge mounted in said discharge chamber;

first electrical connector means connected to said first electrical contact means and extending from said housing for connection to a container to be discharged;

second electrical contact means mounted in said discharge chamber for receiving and dissipating said accumulated electrostatic charge on said first contact means;

second electrical conduction means connected between said second electrical contact means and a charge sink;

at least one of said electrical contact means being slidably mounted in said discharge chamber for movement towards and away from the other electrical contact means between a first position in contact with said other electrical contact means and a second position spaced apart from said other electrical contact means; and said housing having viewing means in at least one of its walls for allowing viewing of said contact means during operation.

16. A discharge control device for transferring accumulated electrostatic charge from containers or other apparatus used in spray painting, to a charge sink, comprising;

a housing;

a hermetically sealed discharge chamber disposed within said housing and having opposing first and second ends;

first electrical contact means for receiving an accumulated electrostatic charge mounted in said discharge chamber;

first electrical connector means connected to said first electrical contact means and extending from said housing for connection to a container to be discharged;

second electrical contact means mounted in said discharge chamber for receiving and dissipating said accumulated electrostatic charge on said first contact means;

second electrical conduction means connected between said second electrical contact means and a charge sink;

at least one of said electrical contact means comprising a reciprocating contact slidably mounted in said discharge chamber for movement towards and away from the other electrical contact means between a first position in contact with said other electrical contact means and a second position spaced apart from said other electrical contact means; and said chamber comprising a hollow support member having opposing first and second ends with aid reciprocating contact slidably mounted on one end of said support member and the other contact means mounted on the opposite end of said support member.

* * * * *